US011103918B2

(12) United States Patent
De Neff

(10) Patent No.: US 11,103,918 B2
(45) Date of Patent: Aug. 31, 2021

(54) CORE BLOWING APPARATUS FOR ROBOTIC SYSTEM

(71) Applicant: Honda Motor Co., Ltd., Tokyo (JP)

(72) Inventor: Robert C. De Neff, Bellefontaine, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 449 days.

(21) Appl. No.: 15/925,440

(22) Filed: Mar. 19, 2018

(65) Prior Publication Data

US 2019/0283117 A1 Sep. 19, 2019

(51) Int. Cl.

| | |
|---|---|
| ***B22C 5/04*** | (2006.01) |
| ***B22C 9/10*** | (2006.01) |
| ***B22C 15/24*** | (2006.01) |
| ***B22C 23/02*** | (2006.01) |
| *B22C 9/02* | (2006.01) |
| *B22C 19/04* | (2006.01) |

(52) U.S. Cl.

CPC ..... *B22C 5/0472* (2013.01); *B22C 9/10* (2013.01); *B22C 15/24* (2013.01); *B22C 23/02* (2013.01); *B22C 9/02* (2013.01); *B22C 19/04* (2013.01)

(58) Field of Classification Search

CPC ..... B22C 5/04; B22C 5/0472; B22C 15/24; B22C 19/04; B22C 9/02; B22C 9/10; B22C 23/02

USPC ..... 164/200, 228

See application file for complete search history.

(56) References Cited

U.S. PATENT DOCUMENTS

| | | | |
|---|---|---|---|
| 4,158,381 | A | 6/1979 | Michelson |
| 4,184,533 | A | 1/1980 | Breitbarth |
| 4,378,835 | A | 4/1983 | Janke |
| 4,445,564 | A | 5/1984 | Zitser et al. |
| 4,452,295 | A | 6/1984 | Zitser et al. |
| 4,744,404 | A | 5/1988 | Sakoda et al. |
| 5,072,775 | A | 12/1991 | Hale et al. |
| 5,078,201 | A | 1/1992 | Nakamura |
| 5,095,967 | A | 3/1992 | Nagarwalla et al. |
| 5,173,237 | A | 12/1992 | Kidd |
| 5,242,008 | A | 9/1993 | Rommel et al. |
| 5,787,957 | A | 8/1998 | Nagarwalla et al. |
| 6,217,819 | B1 | 4/2001 | Wunderlich |
| 6,422,296 | B1 | 7/2002 | Poehlandt et al. |
| 6,904,951 | B2 | 6/2005 | Murayama et al. |
| 2008/0185117 | A1 | 8/2008 | Hirata et al. |
| 2015/0144283 | A1 | 5/2015 | Kato et al. |

FOREIGN PATENT DOCUMENTS

| | | | |
|---|---|---|---|
| EP | 1690614 | A1 | 8/2006 |

*Primary Examiner* — Kevin P Kerns

(74) *Attorney, Agent, or Firm* — Armstrong Teasdale LLP

(57) ABSTRACT

A core blowing device includes a hopper, a fluidizer, a shooting head, and a robotic arm fitting. The core blowing device is configured to removeably couple to a free end of a robotic arm and is configurable to implement a variety of core casting processes using different aggregate materials, binders, catalysts, and/or curing processes.

20 Claims, 4 Drawing Sheets

CORE BLOWING APPARATUS FOR ROBOTIC SYSTEM

BACKGROUND

Casting cores formed from aggregate materials are widely used in casting processes in which the casting cores are situated within a mold, and a flowable material is cast around the aggregate casting core within the mold to form a cavity within the part cast within the mold. The aggregate material employed to form the casting cores may be coated or combined with an additive, such as a resin, and cured to form a hardened and cohesive casting core suitable for use in a casting process.

The aggregate material is typically inserted into a core mold to form the aggregate material into the desired casting core shape. The aggregate material may be poured into the core mold and tamped or otherwise compressed to ensure that the aggregate material contacts the interior surface of the core mold without any voids or other defects that may result in flaws at the surface of the casting core. Alternatively, the aggregate material may be introduced into the core mold using a core shooter that propels the aggregate material into the core mold using high pressure air.

Once situated within the core mold, the aggregate material may be further treated to harden the additive to produce a structurally sound casting core for use in a casting process. The casting core may be conditioned using a "hot box" method, in which the aggregate material is cured at elevated temperatures in a heated core mold. In other cases, the casting core may be conditioned using a "cold box" method, in which the aggregate material cures spontaneously at room temperature, or alternatively an additional additive, such as a catalyst gas, is introduced into the core mold to cure the aggregate material.

Casting cores are typically produced using a dedicated system that conducts all of the steps of the core production method. Although the use of a dedicated system may enhance the efficiency of a manufacturing operation, these dedicated systems may limit the flexibility of the manufacturing operation. Dedicated core fabrication devices are typically compatible with a limited range of aggregate materials and additives, and may be further limited to a single method (i.e. hot box or cold box) of curing the aggregate material. In addition, dedicated core fabrication devices are typically stationary due to their relatively large size, thereby limiting the flexibility of workflow arrangements within a large-scale manufacturing operation.

SUMMARY

In accordance with one embodiment, a core blowing device configured to couple to a free end of a robotic arm is disclosed. The device includes: a robotic arm fitting configured to couple to the free end of the robotic arm; a fluidizer that includes a continuous wall enclosing a fluidizing chamber, the fluidizing chamber opening at opposed upper and lower fluidizer ends; a hopper defining a hopper volume, the hopper volume opening upwards at a hopper mouth and opening downward at a hopper outlet attached to the upper fluidizer end, forming a conduit from the hopper volume into the fluidizing chamber; a fluidizer sealing valve connected between the hopper outlet and the upper fluidizer end, the fluid sealing valve configured to seal the fluidizing chamber when the fluidizer sealing valve is closed; a shooting head attached to the lower fluidizer end, the shooting head defining at least one conduit connecting the fluidizing chamber to at least one mold opening of a core mold, the shooting head further configured to seal against the at least one mold opening; a compressed air source operatively coupled to an inlet fitting formed on an outer wall surface of the fluidizing chamber, the inlet fitting further defining a conduit through the wall of the fluidizer into the fluidizing chamber; and a compressed air valve connected between the compressed air source and the inlet fitting.

In accordance with another embodiment, a method of producing at least one cast core using a core blowing device configured to couple to a free end of a robotic arm is disclosed. The method includes coupling a robotic arm fitting of a core blowing device to the free end of the robotic arm. The core blowing device includes: the robotic arm fitting; a hopper defining a hopper volume connected to a fluidizing chamber; a fluidizer enclosing the fluidizing chamber, the fluidizing chamber reversibly sealed by a fluidizer sealing valve; a shooting head coupled to the fluidizing chamber, the shooting head defining at least one conduit connecting the fluidizing chamber to at least one mold opening of a core mold, the shooting head further configured to seal against the at least one mold opening; a compressed air source operatively coupled to the fluidizing chamber via a compressed air valve; and a binder source connected between the hopper and the fluidizer sealing valve. The method further includes selecting an aggregate material composition to be used to form the core, the aggregate material composition chosen from: a pre-coated aggregate material or an aggregate material with a wet binder. The method further includes introducing the pre-coated aggregate material or the aggregate material into the hopper volume, transferring at least a portion of the pre-coated aggregate material or the aggregate material from the hopper volume into the fluidizing chamber by opening the fluidizer sealing valve, and optionally introducing an amount of the wet binder from the binder source into the aggregate material as the aggregate material is transferred from the hopper volume into the fluidizing chamber if the aggregate material composition is the aggregate material with the wet binder. The method additionally includes sealing the fluidizing chamber by closing the fluidizer sealing valve, and shooting the aggregate material composition from the fluidizing chamber into the core mold opening via the conduit in the shooting head by opening the compressed air valve.

In accordance with an additional embodiment, a core production system is disclosed. The core production system includes a transfer system that includes a robotic arm, a core blowing device configured to removeably couple to the robotic arm and further configured to deliver an aggregate material to a core mold, an aggregate supply bin configured to deliver an aggregate material to the core blowing device, and a core mold configured to produce a core from the aggregate material. In this additional embodiment, the transfer system is configured to position the core blowing device at the aggregate supply bin to receive the aggregate material and to reposition the core blowing device at the core mold to deliver the aggregate material to the core mold.

DETAILED DESCRIPTION

Figure 1:
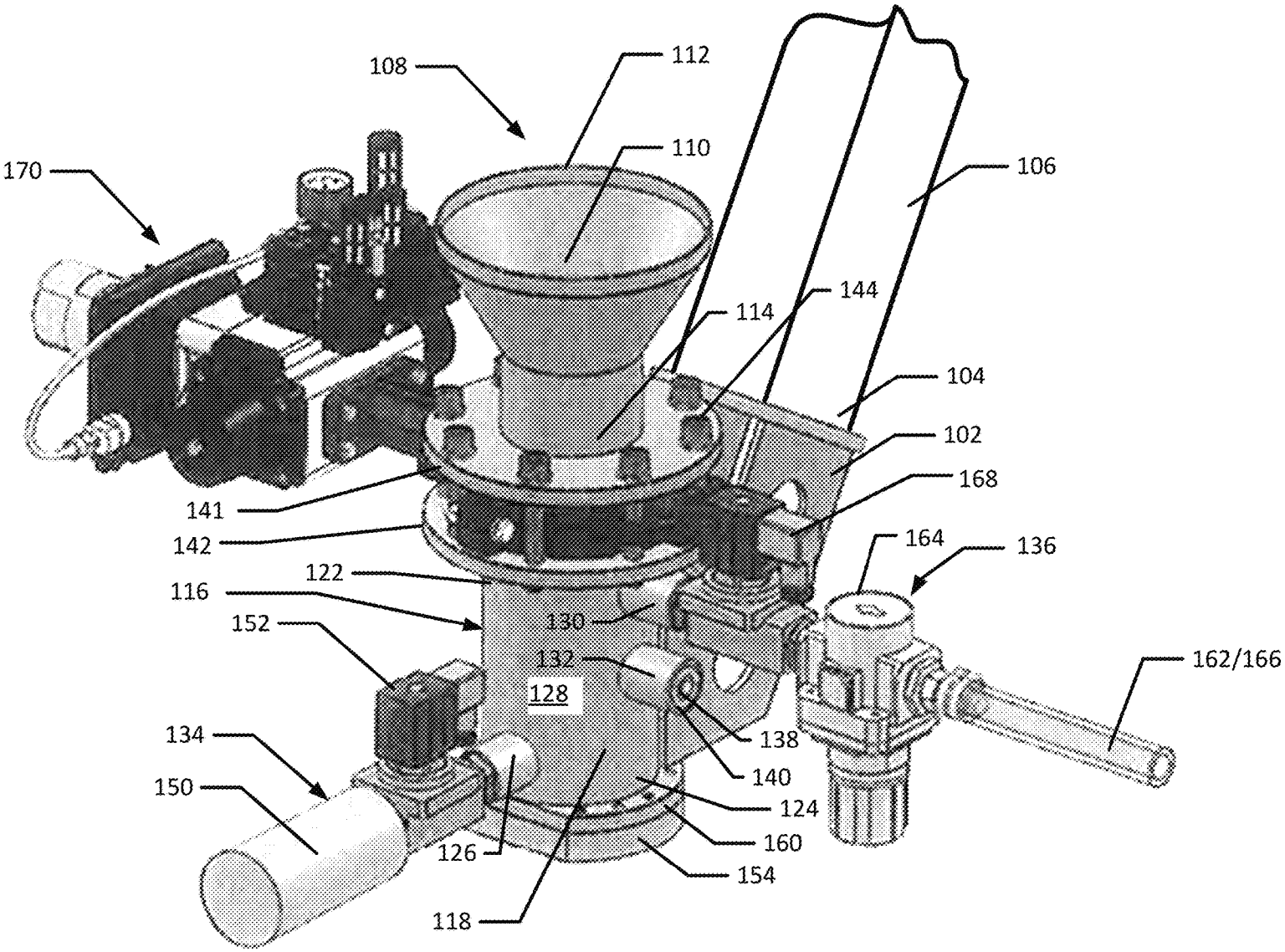
FIG. 1 is a perspective view depicting a robotic core blowing device, in accordance with one embodiment.
Figure 2:
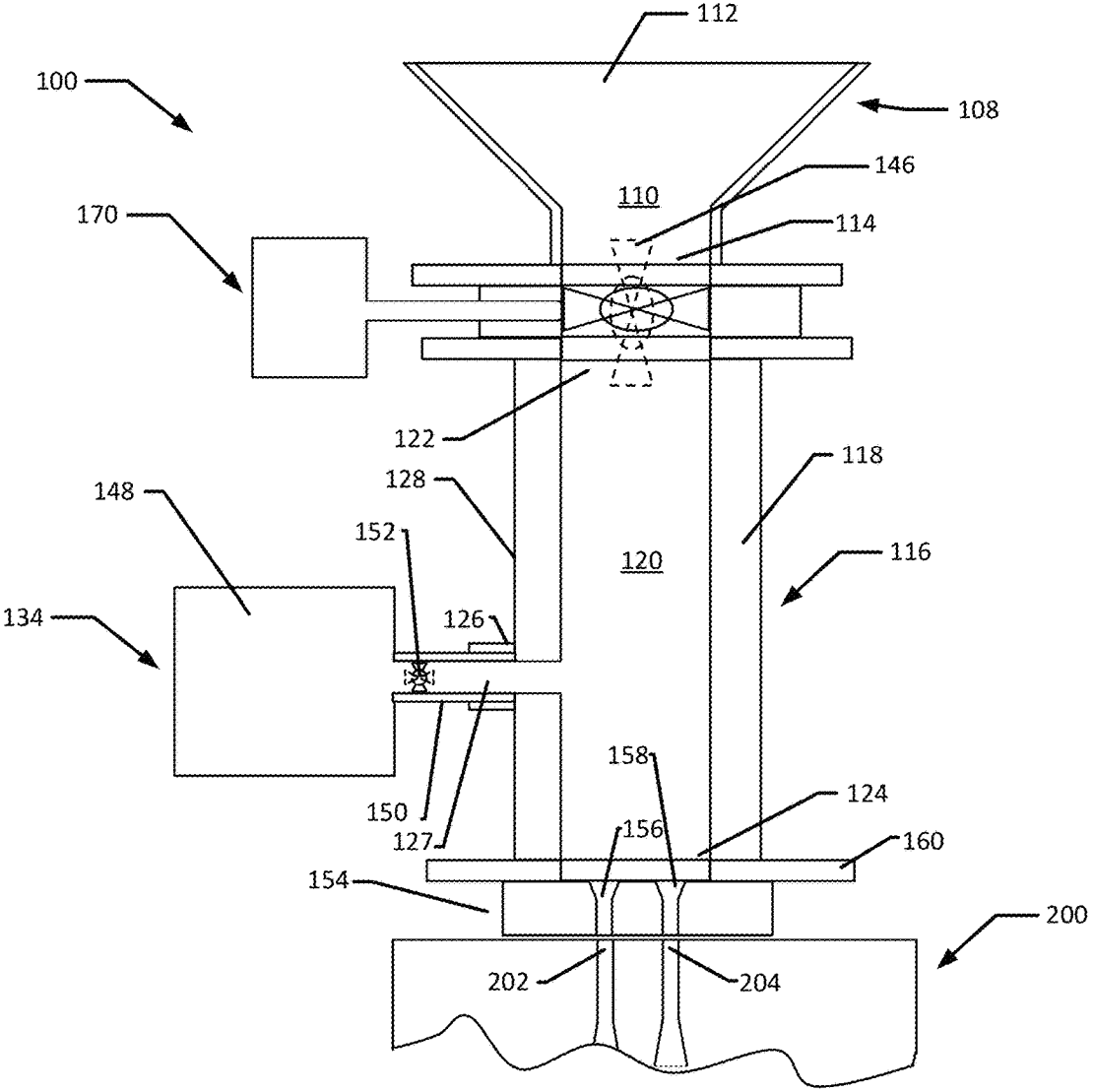
FIG. 2 is a schematic cross-sectional view depicting a robotic core blowing device, in accordance with one embodiment.
Figure 3:
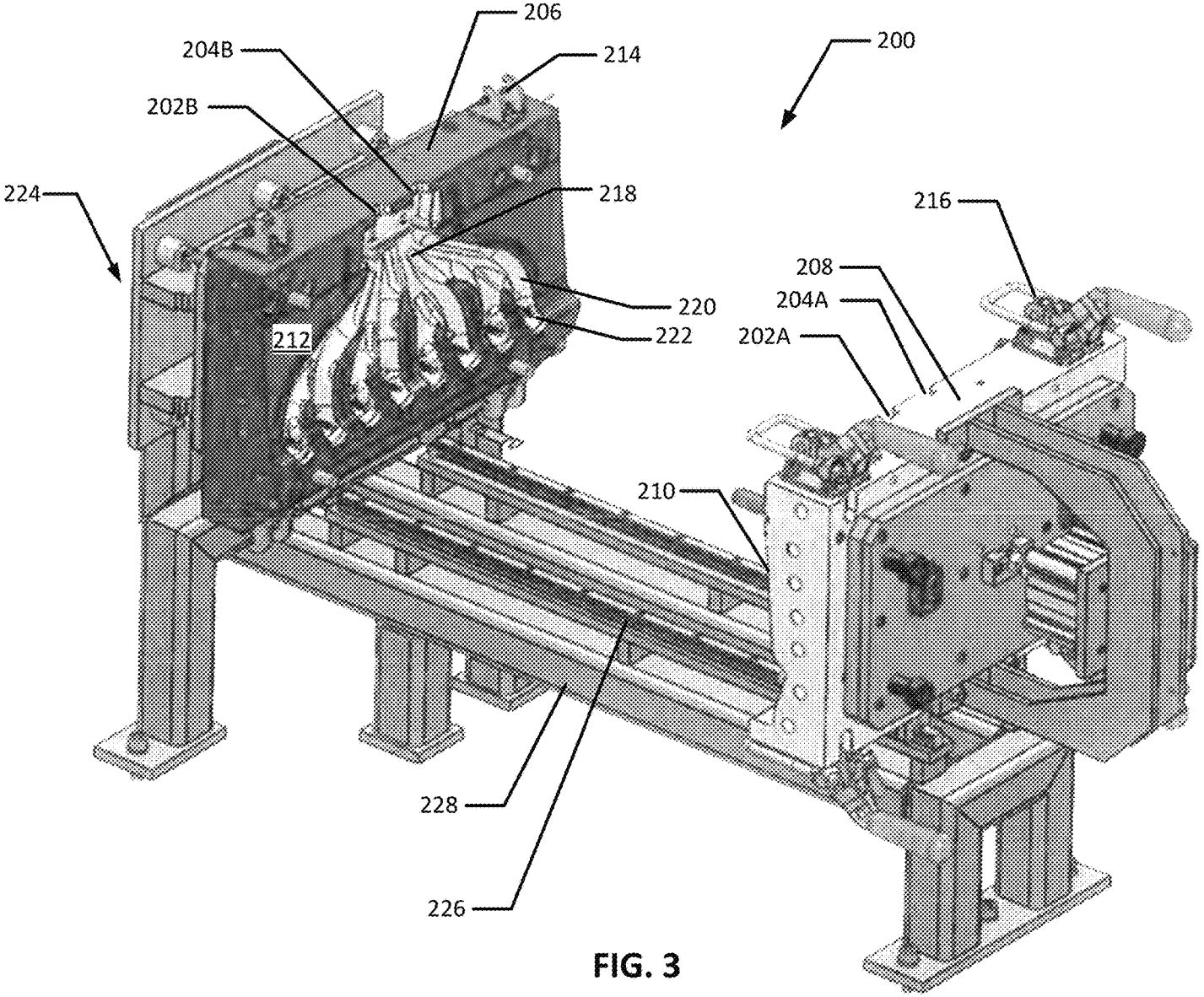
FIG. 3 is a perspective view depicting a core mold assembly in accordance with one embodiment.
Figure 4:
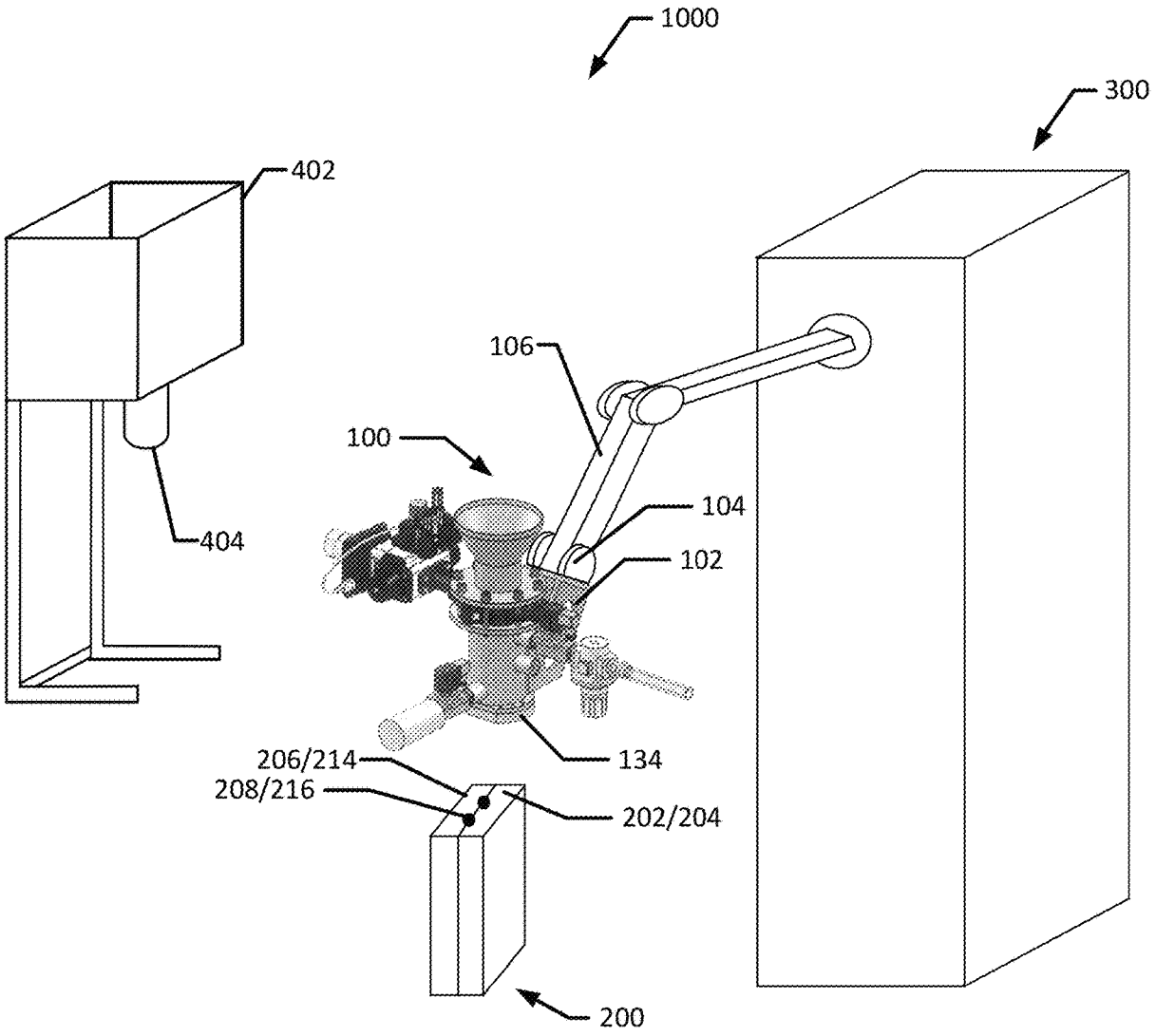
FIG. 4 is a perspective view depicting a robotic core blowing device operatively coupled to a free end of a robotic arm, in accordance with one embodiment.

Embodiments are hereinafter described in detail in connection with the views of FIGS. 1-4, wherein like numbers indicate the same or corresponding elements throughout the views. FIG. 4 is a perspective view of an exemplary core production system 1000. In the exemplary embodiment, the core production system 1000 includes a core blowing device 100, a transfer system (e.g., a robotic arm 106), and an aggregate supply bin 402. The core production processes described herein utilize the core blowing device 100, as illustrated in FIG. 1 and FIG. 2. In various embodiments, the core blowing device 100 transfers an amount of an aggregate material (not shown) at relatively high speed into at least one mold opening 202/204 of a core mold 200 as illustrated in FIG. 3 to form at least one core (not shown).

The core production system 1000 can be converted between a system for producing cores from a first type of aggregate, for example, a dry pre-coated aggregate material such as a dry pre-coated sand aggregate, and a system for producing cores from a second type of aggregate, for example, a wet sand/binder mixture. In one embodiment, the core production system 1000 further includes a second aggregate supply bin (not illustrated) that may contain either the first or second type of aggregate as described above. In another embodiment, the second aggregate supply bin is interchangeable with the first. In an additional embodiment, the first aggregate supply bin 402 contains a first type of aggregate and the second aggregate supply bin contains a second type of aggregate. The inclusion of the second aggregate supply bin enables the core production system 1000 to convert from producing cores from the first type of aggregate to producing cores from the second type of aggregate without need to relocate the robotic arm 106 or to replace or reload the aggregate supply bin 402.

A. Core Blowing Device

Referring again to FIG. 1, the core blowing device 100 includes a robotic arm fitting 102 configured to removeably couple to a free end 104 of the robotic arm 106. In this embodiment, the robotic arm 106 is used to move the core blowing device 100 between the aggregate supply bin 402 and the core mold 200. More specifically, the robotic arm 106 positions the core blowing device 100 adjacent to the aggregate supply bin 402 where aggregate material is transferred from the aggregate supply bin 402 into the core blowing device 100. The robotic arm 106 then positions and seals the core blowing device 100 over the at least one mold opening 202/204 of the core mold 200, as illustrated in FIG. 2.

In some embodiments, the aggregate supply bin 402 is a storage container configured to hold an amount of dry pre-coated sand aggregate. In other embodiments, the aggregate supply bin 402 is a container that includes mixing features for preparing a mixture of inorganic sand and a liquid binder (i.e., a wet mixed sand aggregate).

In various embodiments, the core blowing device 100 may be repositioned by the robotic arm 106 to at least one additional core mold (not illustrated) to enable the production of multiple cores by high speed transfer of aggregate material into multiple core molds. In these various embodiments, the multiple core molds may be configured to produce cores characterized by the same external shape, or each of the multiple core molds 200 may be configured to produce cores of different external shapes.

In various other embodiments, the core production system 1000 further includes a second core blowing device (not illustrated). In one embodiment, the second core blowing device is interchangeable with the core blowing device 100. The second core blowing device may be configured to transfer aggregate material of the same type or configured to transfer aggregate material of a different type as the first core blowing device 100. In embodiment, the core blowing device 100 may be uncoupled from the robotic arm 106 after completion of high speed transfer of aggregate material into one or more core molds 200. In addition, a second core blowing device (not shown) may be coupled to the free end of the robotic arm and used to produce additional cores in a similar manner.

The use of one or more core blowing devices 100 in conjunction with a robotic arm 106 enables considerable flexibility in the implementation of a variety of core casting methods. By way of non-limiting example, a core blowing device 100 may be coupled to a first robotic arm 106 to produce at least one core in one region of a manufacturing facility, and the same core blowing device 100 may be coupled to a second robotic arm to produce additional cores in a second region of the manufacturing facility. By way of another non-limiting example, two or more core blowing devices 100 may be sequentially coupled to the robotic arm 106 to produce multiple cores utilizing different aggregate material compositions, different curing processes, and the like.

Referring again to FIG. 1 and FIG. 2, the core blowing device 100 further includes a hopper 108 defining a hopper volume 110. The hopper volume 110 opens upward to a hopper mouth 112 and further opens downward to a hopper outlet 114. The hopper 108 is configured to receive an amount of aggregate material from aggregate supply bin 402 via the hopper mouth 112. In one embodiment, the hopper 108 may store the aggregate material within the hopper volume 110 for use as needed. The capacity of the hopper volume 110 may be sized to accommodate an amount of aggregate material sufficient to conduct a single transfer of the aggregate material into a single core mold 200 in one embodiment. Less air pressure is needed to fluidize the aggregate material for insertion into the core mold 200 when only the exact amount of aggregate material required to fill one core mold 200 is held within hopper volume 110, when compared to the air pressure needed to fluidize the aggregate material when the amount of aggregate material held within hopper volume 110 is enough to fill multiple core molds 200. The lower air pressure may facilitate cost savings, among other benefits. However, in another embodiment, the hopper volume 110 may be sized to accommodate an excess of aggregate material sufficient to conduct multiple transfers of aggregate material into multiple core molds 200.

In various embodiments, any known composition of aggregate material used for forming core molds is suitable for use with the core blowing device 100. For example, a first type of aggregate material suitable for use with the core blowing device 100 may include resin coated sand compositions in which the sand is pre-coated with a resin prior to use. Non-limiting examples of suitable resin coated sands include phenolic resin coated sand and phenolic urethane resin coated sand. Furthermore, a second type of aggregate material suitable for use with the core blowing device 100 may include an aggregate and a wet binder. The binder serves as a catalyst for the aggregate such that the mixture of the aggregate and binder catalyzes into a solid when exposed to a reactant including, but not limited to, heat, air, vacuum, light, or water. Non-limiting examples of suitable binders include: inorganic binders, such as water-soluble phosphate; silicate-based binders, such as phosphate glass, sodium silicate, magnesium sulfates and other salts and borates; organic binders, such as urethane; or any other suitable binders known in the art. Non-limiting examples of suitable aggregates for inclusion in the aggregate composition include a single sand type, such as silica sand, or a mixture of several different types of sand based on the desired surface qualities of the final casted item. It is to be appreciated that a core can be formed from any of a variety of suitable alternative materials.

Referring again to FIG. 1 and FIG. 2, the core blowing device 100 further includes a fluidizer 116 that includes a continuous wall 118 enclosing a fluidizing chamber 120 configured to transfer aggregate material into the core mold 200. The fluidizing chamber 120 opens at an upper end 122 and at a lower end 124 opposite to the upper end 122. The fluidizer 116 may further include an inlet fitting 126 formed on an outer surface 128 of the wall 118 of the fluidizer 116. The inlet fitting 126 forms a conduit 127 through the wall 118 of the fluidizer 116 into the fluidizing chamber 120. In other embodiments, the fluidizer 116 may further include at least one additional inlet fitting 130/132, also formed on the outer surface 128 and also forming conduits through the wall 118 into the fluidizing chamber 120.

In various embodiments, the inlet fitting 126 and each additional inlet fitting 130/132 is independently sized and provided with features to enable the coupling of an accessory device including, but not limited to, a compressed air source or a catalyst source incorporated to introduce additional materials into the fluidizing chamber 120 as described herein below. Non-limiting examples of features suitable for the inlet fitting 126 and each additional inlet fitting 130/132 include: threaded male connectors, threaded female connectors, quick-connect pressure line fittings, and any other fitting suitable for the attachment of air lines, supply tubes, pipes, conduits, ducts, or any other suitable means of transfer of substances into the fluidizing chamber 120 from external sources. In another embodiment, the connection features of the inlet fitting 126 and each additional inlet fitting 130/132 are capable of maintaining intact fluid connections at fluid pressures ranging up to about 0.5 MPa or higher. In an additional embodiment, one additional inlet fitting 132 is sealed by inserting a threaded cap 138 into a threaded female fitting 140 provided within the additional inlet fitting 132, as illustrated in FIG. 1.

In various embodiments, the hopper 108 is further configured to transfer at least a portion of the amount of aggregate material into the fluidizing chamber 120. Referring again to FIG. 1 and FIG. 2, the hopper outlet 114 may be attached to the upper end 122 of the fluidizer 116, thereby connecting the hopper volume 110 to the fluidizing chamber 120. In one embodiment, the hopper 108 may be provided with a hopper flange 141 and the fluidizer 116 may be provided with an upper fluidizer flange 142 to provide robust structural attachment fittings with which to attach the hopper 108 to the fluidizer 116. In one embodiment, the hopper flange 141 and the upper fluidizer flange 142 may be attached using a plurality of fasteners 144 including, but not limited to, bolts, screws, clamps, rivets, and any other suitable fastener. In one embodiment, the hopper flange 141 may be directly joined to the upper fluidizer flange 142. In another embodiment, additional elements may be situated between the hopper flange 141 and the upper fluidizer flange 142 including, but not limited to: valves, seals, or other flow control devices; devices or sources configured to insert compounds such as binders, catalysts, or any other suitable compound into the aggregate material passing from the hopper 108 into the fluidizer 116; mixers configured to mix the aggregate material and any added compounds prior to transfer into the fluidizer 116; and any combination thereof.

Referring again to FIG. 2, the core blowing device 100 further includes a fluidizer sealing valve 146 connected between the upper end 122 of the fluidizing chamber 120 and the hopper outlet 114 in one embodiment. When the fluidizer sealing valve 146 is opened (shown in dashed lines), the upper end 122 of the fluidizing chamber 120 is opened to the hopper outlet 114, thereby enabling the transfer of aggregate material from the hopper 108 to the fluidizing chamber 120. When the fluidizer sealing valve 146 is closed (shown in solid lines) the upper end 122 of the fluidizing chamber 120 is sealed from the hopper 108. In the sealed configuration, the fluidizer 116 may be used to shoot an amount of aggregate material into a core mold or to introduce a catalyst into the core mold in one embodiment.

In one embodiment, the fluidizer sealing valve 146 is selected to seal the fluidizing chamber 120 throughout all phases of use, including shooting the aggregate material into the core mold 200. Consequently, the fluidizer sealing valve 146 may be selected to provide a seal over the upper end 122 of the fluidizing chamber 120 at the relatively high pressures used to expel the aggregate material from the fluidizing chamber 120 as described herein below. In one embodiment, the fluidizer sealing valve 146 may seal the fluidizing chamber 120 at pressures of up to about 1 MPa. In another embodiment, the fluidizer sealing valve 146 may seal the fluidizing chamber 120 at vacuum pressures to provide for the application of vacuum as a catalyst for the aggregating material within the core mold 200 as described herein below.

Referring again to FIG. 1 and FIG. 2, the core blowing device 100 further includes a compressed air source 134 attached to the fluidizer 116 at the inlet fitting 126 in one embodiment. In one embodiment, the compressed air source 134 may include a high pressure tank 148 connected to the inlet fitting 126 via a high pressure line 150. In other embodiments, the compressed air source 134 may include any suitable high-pressure air supply connected to the inlet fitting 126 via the high pressure line 150. The compressed air source 134 supplies high pressure air to the fluidizer 116 to drive the aggregate material from the fluidizer chamber 120 into the core mold 200 as described herein below. In various embodiments, including embodiments where the exact amount of aggregate material required to fill one core mold 200 is held within hopper volume 110, the compressed air source 134 may supply pressurized air to fluidizer 116 at a pressure of up to about 1 MPa. In other embodiments, the compressed air source 134 may supply pressurized air at a pressure ranging from about 0.01 MPa to about 1 MPa, from about 0.05 MPa to about 0.75 MPa, and from about 0.1 MPa to about 0.5 MPa. In an embodiment where the amount of aggregate material held within hopper volume 110 is enough to fill multiple core molds 200, the compressed air source 134 may supply pressurized air to fluidizer 116 at a pressure of about 3 MPa.

In another embodiment, a compressed air valve 152 is connected between the compressed air source 134 and the inlet fitting 126. When the compressed air valve 152 is closed (solid lines), the high pressure tank 148 or other high pressure air supply is sealed off from the fluidizing chamber 120, thereby maintaining the fluidizing chamber 120 at essentially atmospheric pressure. When the compressed air valve 152 is opened (dashed lines), the pressure within the fluidizing chamber 120 rapidly equilibrates to the elevated pressure of the high pressure tank 148 or other high pressure air supply. If the fluidizer sealing valve 146 and the one or more additional inlet fittings 130/132 are sealed, the elevated pressure within the fluidizing chamber 120 expels the air, along with any aggregate material, out of the fluidizing chamber 120 and into the core mold 200 via a shooting head 154 as described herein below.

Referring again to FIG. 1 and FIG. 2, the core blowing device 100 further includes a shooting head 154 attached to the lower end 124 of the fluidizer 116. In one embodiment, the shooting head 154 includes at least one passage defined through the shooting head 154 including, but not limited to, a first passage 156. In another embodiment, the shooting head 154 further includes a second passage 158. In various embodiments, the shooting head 154 includes any number of passages that allow the core blowing device 100 to function as described herein.

Referring again to FIG. 2, in one embodiment the passages 156 and 158 are aligned with the mold openings 202 and 204 of the core mold 200, and thus define conduits connecting the fluidizing chamber 120 with the mold openings 202/204 of the core mold 200. In various other embodiments, the shooting head 154 may include 1 passage, 2 passages, 3 passages, 4 passages, 5 passages, 6 passages, 7 passages, 8 passages, 9 passages, 10 passages, 15 passages, 20 passages, 30 passages, 50 passages, and 100 or more passages.

The shooting head 154 transfers aggregate materials from the fluidizing chamber 120 into the mold openings 202/204 of the core mold 200 using the propulsive force of pressurized air delivered by the compressed air source 134. Without being limited to any particular theory, the reduced total cross-sectional area of the passages 156/158 compared to the cross-sectional area of the fluidizing chamber 120 results in acceleration of air flow through the passages 156/158 according to well-known thermodynamic principles including, but not limited to, the law of continuity and the conservation of energy as expressed in Bernoulli's equation. Accordingly, the size and number of passages included in the shooting head 154 may be sized and dimensioned to enable a desired air velocity in response to the elevated pressure level induced by the compressed air source 134 in one embodiment. In another embodiment, the number, size, and spatial arrangement of the passages included in the shooting head 154 may be selected to match the corresponding the number, size, and spatial arrangement of the mold openings of the core mold 200.

The shooting head 154 may be attached to the lower end 124 of the fluidizer 116 by any suitable means. In one embodiment, the fluidizer 116 may be provided with a lower fluidizer flange 160 to provide a robust attachment fitting for the shooting head 154. In various embodiments, the shooting head 154 is attached to the fluidizer 116 using a plurality of suitable fasteners including, but not limited to: screws, bolts, rivets, and any other suitable fastener. In various other embodiments, the shooting head 154 is removeably coupled to the fluidizer 116 using a reversible fastener including, but not limited to: quick-release levers, meshing twist-on fittings, clamps, and any other suitable reversible fastener.

When the shooting head 154 is removeably coupled to the fluidizer 116, the shooting head 154 may be easily removed and reattached or alternatively may be replaced by a second shooting head (not illustrated). In one embodiment, the second shooting head is interchangeable with the first shooting head 154. In one embodiment, the shooting head 154 may be removed for cleaning and/or unclogging the passages 156/158 as part of a typical maintenance routine. In another embodiment, the shooting head 154 may be removed and replaced by a second shooting head. By way of non-limiting example, the second shooting head may be identical to the original shooting head 154. In this example, the second shooting head may be used to replace a worn or clogged shooting head 154 as part of a maintenance routine.

In an additional embodiment, the shooting head 154 may be removed and replaced by the second shooting head with a different pattern of passages compared to the shooting head 154. In this embodiment, the second shooting head may be used to enhance the performance of the core blowing device 100. Also in this embodiment, the second shooting head may be used to reconfigure the core blowing device 100 for use in a different core blowing process. In various embodiments, the second shooting head may accommodate for changes in the core blowing process including, but not limited to: differences in the number, size, or pattern of mold openings in the core mold; differences in aggregate material composition; differences in catalyst compositions or catalyzing methods; and differences in curing conditions such as hot box versus cold box curing processes.

In another embodiment, the shooting head 154 and the second shooting head are configured for use in blowing cores from a first and second aggregate material, respectively. In this other embodiment, the core production system 1000 may produce cores from the first aggregate material using the shooting head 154, and the shooting head 154 may be removed and replaced by the second shooting head to reconfigure the core production system 1000 to produce cores from the second aggregate material. In addition, the shooting head 154 may receive the first aggregate material from the first aggregate supply bin 402 and the second shooting head may receive the second aggregate material from the second aggregate supply bin (not illustrated).

Referring again to FIG. 1, the core blowing device 100 further includes a catalyst source 136 attached to one of the additional inlet fittings 130/132 in one embodiment. The catalyst source 136 provides an amount of a catalyst to the aggregate material within the core mold 200 after the aggregate material is transferred into the core mold 200 as described herein. The catalyst source 136 is selected to be compatible with the aggregate material, binder, and/or curing method used to produce the cast core in various embodiments. In one embodiment, a catalyst valve 168 is attached between the inlet fitting 130 and the catalyst source 136. When the catalyst valve 168 is closed, the catalyst source 136 is sealed off from the fluidizer 116. When the catalyst valve 168 is opened and the fluidizer sealing valve 146 is closed to seal the fluidizer 116 from the hopper 108, a catalyst is transferred from the catalyst source 136 into the fluidizing chamber 120. The catalyst further transfers from the fluidizing chamber 120 into the core mold 200 through the passages 156/158 of the shooting head 154.

In a first embodiment, the catalyst source 136 is a gas source (not illustrated) connected to the inlet fitting 130 via a fluid line 162. In this first embodiment, the catalyst source 136 delivers a catalyst gas including, but not limited to, carbon dioxide, to the fluidizing chamber 120 and core mold 200 by way of the passages 156/158 of the shooting head 154. In this first embodiment, the catalyst source 136 alternatively delivers an amount of heated air to heat the aggregate material and binder within the core mold as part of a curing process. In one embodiment, the catalyst source 136 includes a backflow valve 164 to prevent the backflow of the contents of the fluidizing chamber 120 into the catalyst source 136. In a second embodiment, the catalyst source 136 is a vacuum source (not illustrated) connected to the inlet fitting 130 via a vacuum line 166. In a third embodiment, the catalyst source 136 is a water source (not illustrated) connected to the inlet fitting 130 via the fluid line 162. In this third embodiment, the catalyst source 136 may deliver water to the core mold 200 in any form including, but not limited to, liquid water and water vapor mixed with a carrier gas such as air.

In one embodiment, the core blowing device 100 receives an amount of aggregate material mixed with a binder in the hopper 108, and subsequently transfers the aggregate material/binder mixture into the core mold without introducing any additional compounds into the aggregate material/binder mixture within the core blowing device 100. Referring again to FIG. 1 and FIG. 2, the core blowing device 100 may further include a binder source 170 attached between the hopper outlet 114 and the upper end 122 of the fluidizer 116 in one embodiment. The binder source 170 introduces an amount of a binder into the aggregate material as the aggregate material is transferred from the hopper 108 to the fluidizer 116. The binder introduced into the aggregate material by the binder source 170 may be any suitable binder including, but not limited to, resins; inorganic binders, such as water-soluble phosphate; silicate-based hinders, such as phosphate glass; and any other suitable binder known in the art. In various embodiments, the binder source 170 includes elements or devices to form the binder and to apply the binder to the aggregate material including, but not limited to: heaters, mixers, sprayers, one or more supply lines connected to sources supplying ingredients of the binder composition, and any other suitable element of device.

In an additional embodiment, the core blowing device 100 includes a mixer (not illustrated) attached between the hopper 108 and the fluidizer 116. In one embodiment, the mixer mixes an amount of aggregate material and an amount of binder received from the hopper 108 to produce an aggregate material/binder mixture that is transferred into the fluidizing chamber 120. In another embodiment, the mixer mixes an amount of aggregate material received from the hopper 108 and an amount of binder received from the binder source 170 to produce an aggregate material/binder mixture that is transferred into the fluidizing chamber 120.

B. Core Mold

The core blowing device 100 is used to transfer an amount of an aggregate material and a binder into a core mold 200. Referring to FIG. 3, the core mold 200 includes a first half 206 and a second half 208 that are pressed together at their respective contacting surfaces 210/212. The first half 206 and the second half 208 are held together by a plurality of reversible fasteners including, but not limited to, a first fastener element 214 attached to the first half 206 and a second fastener element 216 attached to the second half 208 of the core mold 200. By way of non-limiting example, the first fastener element 214 may be a mechanical catch attached to the first half 206 at each corner and the second fastener element 216 may be a clasp attached at each corner of the second half 208. In this example, the clasps and the corresponding mechanical catches may mechanically mesh to press the contacting surfaces 210/212 of the first and second halves 206/208 together to form the core mold 200.

Each of the contacting surfaces 210/212 includes a first recess 202A/202B and a second recess 204A/204B defining the core openings 202/204 of the core mold 200. The contacting surfaces 210/212 further include additional recesses defining a manifold 218 connecting with the first and second core openings 202/204. The manifold 218 branches into a plurality of arms 220 and each arm ends in a core region 222 defining the outer shape of each core to be produced.

In one embodiment, the first half 206 and the second half 208 of the core mold 200 may be mounted on a core frame 224 that includes a track 226 supported by a horizontal structural member 228 of the core frame 224. In one embodiment, illustrated in FIG. 3, the first half 206 may be immobilized on the core frame 224 and the second half 208 may be mounted on the track 226 so that the second half 208 may be slid along the track 226 toward the first half 206 and fastened to the first half 206 using the provided fasteners as described herein previously. The use of the core track 226 ensures the alignment of the first and second halves 206/208 when the first and second contacting surfaces 210/212 are pressed together, thereby minimizing variability in the dimensions of the resulting cores. Further, the core track 226 may be compatible with automated production devices and methods, thereby enhancing the efficiency of manufacturing operations.

If the cores are to be produced using a hot box method, the core mold 200 is optionally heated using any known means including a microwave heater, a furnace, a heated table, and any other known heating means.

In various embodiments, the core mold 200 may be maintained at any orientation without limitation. In one embodiment, the core mold 200 is maintained in a vertical orientation with the mold openings 202/204 facing upwards, as illustrated in FIG. 2 and FIG. 3. In another embodiment, the core mold 200 is maintained in a horizontal orientation. In yet another embodiment, the core mold 200 is maintained in a vertical orientation with the mold openings 202/204 facing downwards. Because the core blowing device 100 is mounted on a robotic arm 106, the core blowing device may be translated and rotated to accommodate any of the embodiments of the core mold with respect to the orientation of the core mold 200.

Although only one core mold 200 is shown in FIG. 3, since the core blowing device 100 is mounted on robotic arm 106, the core blowing device 100 can deliver material to any number of other core molds 200 that are within the reach of robotic arm 106. For example, core blowing device 100 may be configured to deliver material to a first core mold, and subsequently deliver material to a second core mold while the first core is being heated and/or is curing. By separating the material delivery process from the core heating/curing process, multiple cores can be heating and/or curing at the same time, therefore, increasing the efficiency of the core making process.

C. Method of Producing Cast Cores

In various embodiments, the core blowing device 100 may be used to produce casting cores as described herein below. In one embodiment, the method includes removeably coupling a robotic arm fitting 102 to a free end 104 of a robotic arm 106, as illustrated in FIG. 1 and FIG. 4. When the core blowing device 100 is coupled to the robotic arm 106, all valves are typically closed to seal the fluidizing chamber 120 and from the hopper 108, and to prevent any release of binders, compressed air, catalysts, and any other materials from sources connected to the fluidizer 116 as described herein above. The robotic arm 106 is part of a robotic system 300, illustrated in FIG. 4 that provides robotic arm segments, actuators, and the like that enable the translation and rotation of the core blowing device 100 by the robotic arm 106.

In this embodiment, the method includes actuating the robotic arm 106 to align the hopper mouth 112 with a chute 404 of the aggregate supply bin 402. The aggregate supply bin 402 is configured to provide a predetermined amount of aggregate material to the core blowing device 100. The method further includes actuating the robotic arm 106 to align the at least one passage 156/158 of the shooting head 154 with the corresponding mold openings 202/204 of the core mold 200. The method further includes actuating the robotic arm 106 to seal the shooting head 154 of the core blowing device 100 against the core mold 200. By way of one non-limiting example, the robotic arm 106 may press the shooting head 154 against the core mold 200 with sufficient pressure to form the seal. By way of another non-limiting example, the robotic arm 106 and/or the core blowing device 100 may include additional elements, such as hydraulically actuated grabbers or hooks that mechanically mesh with corresponding features of the core mold 200 to form the seal.

The method further includes introducing an aggregate material into the hopper volume 110. In one embodiment, the aggregate material is introduced into the hopper volume 110 with no additional additives. In another embodiment, a mixture of the aggregate material and a binder is introduced into the hopper volume 110. In yet another embodiment, the aggregate material and the binder are introduced separately into the hopper volume 110. In this other embodiment, the aggregate material and binder are mixed within the fluidizing chamber 120 or alternatively within a mixer provided with the core blowing device 100 as described herein above.

The method further includes opening the fluidizer sealing valve 146 to transfer at least a portion of the aggregate material from the hopper volume 110 to the fluidizing chamber 120. In one embodiment, the entire amount of the aggregate material in the hopper volume 110 is transferred into the fluidizing chamber 120. In this one embodiment, the amount of aggregate material may be measured prior to introducing the aggregate material into the hopper 108 to ensure that an appropriate amount of aggregate material is introduced into the fluidizing chamber 120. In another embodiment, a portion of the aggregate material is transferred from the hopper volume 110 to the fluidizing chamber 120. In this other embodiment, the fluidizer sealing valve 146 is left open for a time sufficient to transfer a predetermined amount of aggregate material from the hopper volume 110 to the fluidizing chamber 120. To this end, the core blowing device 100 may further include sensors to measure the amount of aggregate material transferred into the fluidizing chamber 120. Non-limiting examples of suitable sensors include flow sensors, scales, volume sensors, and any other suitable sensor.

In one embodiment, when the aggregate material composition used to create the core mold includes an aggregate material and a wet binder, the method may optionally further include introducing an amount of the wet binder into the aggregate material as the aggregate material is transferred from the hopper 108 to the fluidizer 116. In this embodiment, the binder is introduced by activating the binder source 170 during at least a portion of the period during which the fluidizer sealing valve 146 is open during the transfer of the aggregate material into the fluidizer 116. In one embodiment, the binder is mixed with the aggregate material within the fluidizer 116 as part of the transfer from the fluidizing chamber 120 into the core mold 200. In another embodiment, the binder is mixed with the aggregate material within a mixer provided with the core blowing device 100 as described herein previously, prior to the transfer of the aggregate material and binder to the fluidizing chamber 120.

The method further includes closing the fluidizer sealing valve 146 to seal the fluidizing chamber 120 and subsequently opening the compressed air valve 152 to introduce high pressure air into the fluidizing chamber 120. With the fluidizer sealing valve 146 in the closed position, the only outlet for the high pressure air and fluidized aggregate material within the fluidizing chamber 120 is through the passages 156/158 of the shooting head 154. The compressed air and entrained fluidized aggregate material/binder mixture are expelled from the shooting head 154 at relatively high velocity into the mold openings 202/204 and into the interior of the core mold 200. The method further includes closing the compressed air valve 152 to shut off the introduction of compressed air into the fluidizer 116.

In various embodiments, if the aggregate material/binder mixture in the core mold 200 does not require the transfer of additional catalysts from the core blowing device 100, the robotic arm 106 is actuated to move the core blowing device 100 off of the core mold 200, and the core blowing device 100 is then uncoupled from the robotic arm 106. By way of non-limiting example, if the aggregate material/binder mixture within the core mold 200 is to be cured by a hot box method, in which the core mold 200 is to be maintained at an elevated temperature ranging from about 200° C. to about 400° C., the core blowing device 100 may be removed from the core mold 200 and decoupled from the robotic arm 106 after completing the transfer of the aggregate material/binder mixture into the core mold 200.

In some embodiments, the method includes introducing a catalyst into the aggregate material within the core mold 200. After the aggregate material is transferred into the core mold 200, the fluidizer sealing valve 146 and the compressed air valve 152 are both in a closed position. To introduce the catalyst, the catalyst valve 168 is opened to transfer the catalyst from the catalyst source 136 to the fluidizing chamber 120. Because the fluidizing chamber 120 is sealed except for the passages 156/158 of the shooting head 154, the catalyst moves from the fluidizing chamber 120 into the core mold 200 via the shooting head 154. In one embodiment, the catalyst source 136 is a vacuum source and opening the catalyst valve 168 results in the formation of a vacuum within the core mold 200 via the fluidizing chamber 120 and the passages 156/158 of the shooting head 154.

In various other embodiments, the method may further include producing additional cores using a second core blowing device. The method further includes removeably coupling the robotic arm fitting 102 of the second core blowing device to the free end 104 of the robotic arm 106 and performing the steps of the method as described herein previously including, but not limited to: aligning the second core blowing device with a second core mold, introducing an aggregate material into the hopper 108, transferring the aggregate material into the fluidizing chamber 120, and transferring the aggregate material into the second core mold.

As described above, the core production system 1000 provides a manufacturing facility with the flexibility to produce cores from a first type of aggregate or a second type of aggregate. For example, the core production system 1000 may be initially installed within a manufacturing facility and configured to produce cores from a dry pre-coated sand aggregate. This first configuration may include core molds configured for curing dry pre-coated sand aggregate. As production requirements, aggregate costs, or other factors change, the core production system 1000 may be re-configured to produce cores from a wet sand/binder aggregate. This second configuration may include configuring the aggregate supply bin 402 to store and/or mix the wet sand/binder aggregate, and also may include core molds configured for curing wet sand/binder aggregate. These configuration changes can be made for reasonable costs and in a reasonable period of time when compared to replacing a system dedicated to producing cores from only one type of aggregate.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather it is hereby intended the scope be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A core production system, comprising:

a transfer system comprising a robotic arm;

a core blowing device removeably coupled to the robotic arm, the core blowing device configured to receive an aggregate material;

an aggregate supply bin configured to deliver the aggregate material to the core blowing device; and a core mold configured to produce a core from the aggregate material, wherein the robotic arm is configured to position the core blowing device at the aggregate supply bin to receive the aggregate material and translate and rotate the core blowing device to reposition the core blowing device from the aggregate supply bin to the core mold to deliver the aggregate material to the core mold.

2. The core production system of claim 1, wherein the aggregate supply bin is configured to provide only an amount of aggregate material that does not substantially exceed a pre-determined amount of aggregate material to be provided to the core mold.

3. The core production system of claim 1, wherein the aggregate material comprises one of a first aggregate material comprising a dry pre-coated aggregate material and a second aggregate material comprising a mixture of inorganic sand and a liquid binder.

4. The core production system of claim 3, wherein the core blowing device is a first core blowing device configured to deliver the first aggregate material to the core mold, the system further comprising a second core blowing device configured to deliver the second aggregate material to the core mold, wherein the second core blowing device is interchangeable with the first core blowing device.

5. The core production system of claim 3, wherein the core blowing device comprises a first shooting head configured to deliver the first aggregate material to the core mold, the system further comprising a second shooting head configured to deliver the second aggregate material to the core mold, wherein the second shooting head is interchangeable with the first shooting head.

6. The core production system of claim 3, wherein the aggregate supply bin is a first aggregate supply bin configured to deliver the first aggregate material to the core blowing device, the system further comprising a second aggregate supply bin configured to deliver the second aggregate material to the core blowing device, wherein the second aggregate supply bin is interchangeable with the first aggregate supply bin.

7. The core production system of claim 6, wherein the second aggregate supply bin is further configured to prepare the mixture of inorganic sand and the liquid binder prior to delivering the second aggregate material to the core blowing device.

8. The core production system of claim 1, wherein the core blowing device comprises a robotic arm fitting coupled to a free end of the robotic arm.

9. The core production system of claim 1, wherein the core blowing device comprises a fluidizer comprising a continuous wall enclosing a fluidizing chamber, the fluidizing chamber opening at opposed upper and lower fluidizer ends.

10. The core production system of claim 9, wherein the core blowing device comprises a hopper defining a hopper volume, the hopper volume opening upwards at a hopper mouth and opening downward at a hopper outlet attached to the upper fluidizer end, forming a conduit from the hopper volume into the fluidizing chamber.

11. The core production system of claim 10, wherein the core blowing device comprises a fluidizer sealing valve connected between the hopper outlet and the upper fluidizer end, the fluidizer sealing valve configured to seal the fluidizing chamber when the fluidizer sealing valve is closed.

12. The core production system of claim 11, wherein the core blowing device comprises a shooting head attached to the lower fluidizer end, the shooting head defining at least one conduit connecting the fluidizing chamber to at least one mold opening of the core mold, the shooting head further configured to seal against the at least one mold opening.

13. The core production system of claim 12, wherein the core blowing device comprises:

a compressed air source operatively coupled to an inlet fitting formed on an outer wall surface of the fluidizing chamber, the inlet fitting further defining a conduit through the wall of the fluidizer into the fluidizing chamber; and a compressed air valve connected between the compressed air source and the inlet fitting.

14. The core production system of claim 13, wherein the fluidizer chamber is configured to transfer aggregate material from the fluidizer chamber into the core mold via the at least one conduit of the shooting head when the fluidizer sealing valve is closed and the compressed air valve is opened.

15. The core production system of claim 13, wherein the core blowing device further comprises at least one additional inlet fitting formed on the outer wall surface of the fluidizing chamber, each additional inlet fitting further defining a conduit through the wall of the fluidizer into the fluidizing chamber.

16. The core production system of claim 15, wherein the core blowing device further comprises a catalyst source coupled to one of the at least one additional inlet fittings and a catalyst valve connected between the catalyst source and the at least one additional inlet fitting, wherein the catalyst source is configured to introduce a catalyst into the core mold via the fluidizer chamber and the conduit of the shooting head when the catalyst valve is opened and the fluidizer sealing valve is closed.

17. The core production system of claim 11, wherein the hopper is configured to receive and store an amount of aggregate material when the fluidizer sealing valve is closed.

18. The core production system of claim 11, wherein the hopper is configured to transfer at least a portion of the aggregate material from the hopper volume into the fluidizing chamber when the fluidizer sealing valve is open.

19. The core production system of claim 11, wherein the core blowing device further comprises a binder source connected between the hopper outlet and the fluidizer sealing valve, wherein the binder source is configured to introduce an amount of a binder into the aggregate material as the aggregate material passes into the fluidizing chamber.

20. The core production system of claim 19, wherein the binder source further comprises a mixer configured to mix the aggregate material and the amount of the binder prior to transfer into the fluidizing chamber.

* * * * *